United States Patent [19]

Anderson, deceased et al.

[11] 4,177,037

[45] Dec. 4, 1979

[54] METHOD FOR MULTICOLOR DYEING OF TEXTILE YARNS

[76] Inventors: Harald Anderson, deceased, late of Summit, N.J.; by Aelita Anderson, administrator, 18 King's Hill Court, Summit, N.J. 07901; by Michael S. Cozine, administrator, 140 Market St., Paterson, N.J. 07505

[21] Appl. No.: 836,069

[22] Filed: Sep. 23, 1977

Related U.S. Application Data

[62] Division of Ser. No. 712,186, Aug. 6, 1976, Pat. No. 4,068,502.

[51] Int. Cl.[2] ..... D06B 1/02

[52] U.S. Cl. ..... 8/149; 8/155

[58] Field of Search ..... 68/205 R, 205 E; 8/155, 8/149, 155.1

[56] References Cited

U.S. PATENT DOCUMENTS

| | | | |
|---|---|---|---|
| 2,425,214 | 8/1947 | Voelker et al. | 68/205 R |
| 3,620,662 | 11/1971 | Miyamoto et al. | 68/205 R X |
| 3,650,674 | 3/1972 | Newton | 68/205 R X |

*Primary Examiner*—Philip R. Coe
*Attorney, Agent, or Firm*—Luke J. Wilburn, Jr.; Wellington M. Manning, Jr.

[57] ABSTRACT

Method and apparatus for the high speed, multicolor dyeing of yarns to obtain uniformly dyed lengths of different color along the length of the yarns, wherein a moving strand is collected in a plurality of layers on the surface of a winding drum while a plurality of streams of dye of different color are continuously applied in metered amounts onto the outer surface of the yarn on the drum to form radial bands of color in the collected yarn. The drum is rotated at high speed to cause radial outward flow of dye from inner yarn windings into the outer yarn windings on the drum, thereby providing uniform penetration and coloration of the yarn by the dyes. Dye centrifugally expelled from the outer surface of the yarn is collected and removed by an outer housing peripherally surrounding the drum. The traverse speed of the yarn traverse mechanism of the drum is independently variable to permit the dyeing of yarn sections of selectively variable lengths.

4 Claims, 2 Drawing Figures

METHOD FOR MULTICOLOR DYEING OF TEXTILE YARNS

Figure 1:
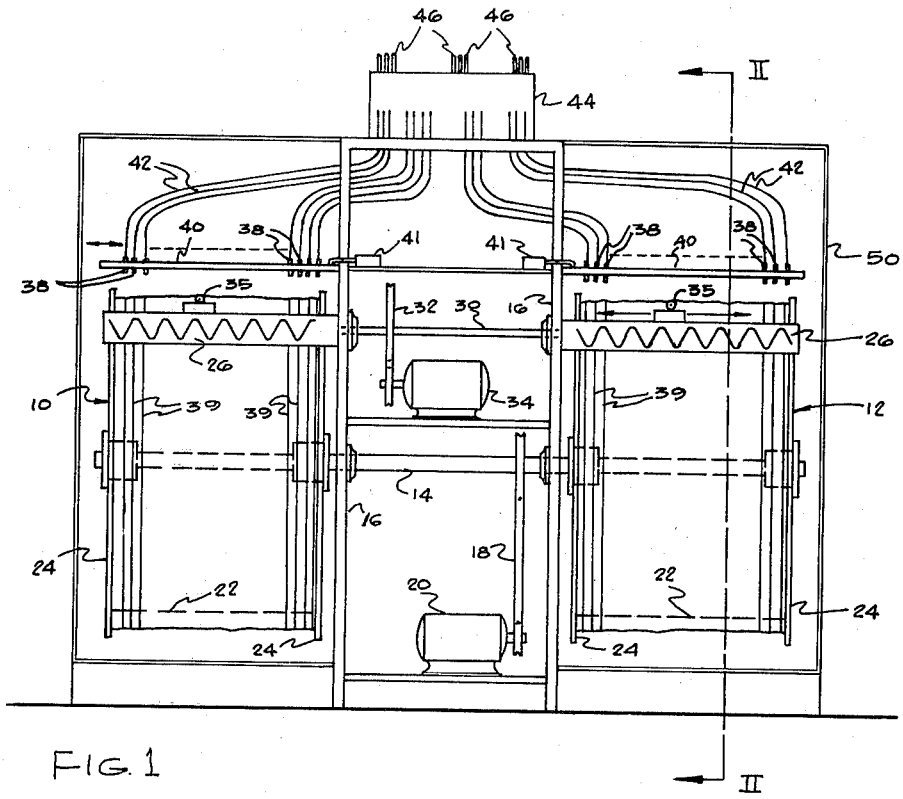

This is a division of application Ser. No. 712,186, filed Aug. 6, 1976, and now U.S. Pat. No. 4,068,502.

The present invention relates to the production of multicolored textile yarns and, more particularly, to a method for the high speed dyeing of a moving yarn strand to produce differently colored sections along the length of the yarn.

Multicolored yarns are well known in the textile industry and are used extensively in manufacturing various randomly colored textile products, such as woven, knit, and pile fabrics including tufted carpets. Various apparatus are known which apply plural dyes to differently color spaced lengths of a moving yarn strand. Devices are known wherein a running yarn strand is passed beneath one or more dye applicators which direct streams of dye transversely to the path of movement of the yarn, and wherein the yarn and/or the dye applicators are transversely reciprocated to subject intermittent lengths of the strand to dye streams of different color. Certain of such devices are described in U.S. Pat. Nos. 2,182,752; 3,620,662; and 3,899,903. It is also known to apply plural dyes of different colors to the outer surface of a yarn package as the yarn is wound onto a textile support bobbin or spool during the formation of a neat yarn package. Such devices are disclosed in U.S. Pat. Nos. 1,627,850 and 3,650,674.

Many problems are encountered in the multicolor dyeing of moving yarn strands particularly when it is desired to dye sections of large heavy denier yarns, such as carpet yarns, uniformly and to a deep rich color. When dyes are applied from discharge applicators located on one side of the yarn path of travel, it difficult to obtain full penetration and uniform distribution of the dye throughout the yarn strand bundle, with the result that cross-sectional shading of color can occur through the yarn bundle with little or no color on the side of the strand away from dye applicator. Therefore, unless only light, pastel shades or mottled, speckled color appearances are desired in the yarns, the larger yarns either must be moved at a very slow rate of speed past the dye applicators, or excessive amounts of dye must be applied to the yarns to provide uniform deep coloration of the strands by the dye. Very slow yarn movement and excess application of dye during the dyeing operation are both economically undesirable for an efficient commercial operation. Also, when large amounts of dyes of different color are applied to sectional lengths of a yarn strand, it is difficult to avoid bleeding, wicking, and transfer of liquid dye from one yarn section into another section of different color until the colors have been fixed in the yarns by cold batch or steam fixation.

In addition, it is often the case that when multicolored yarns are incorporated in textile fabrics, such as pile carpets, there is a tendency for the colored yarns to become phased or located in such a way that repeating sections of the same color produce an undesirable visual row or streak of color in the fabric. Thus, in a dyeing operation, it is desirable that the dyeing apparatus be readily capable of widely varying the placement of the colors and the lengths of the dyed sections of yarn so as to eliminate any undesirable streaks or rows of color in the fabric construction in which the yarn is employed. In dye systems wherein the dyes are applied to the surface of a yarn during build up of a neat yarn package, the ability to vary the dyed lengths is obviously limited by the critical package wind and traverse speed relationships which are necessary for the formation of a self-supporting package which may be easily unwound after dyeing.

It is therefore an object of the present invention to provide a method for the high speed, uniform multicolor dyeing of yarn strands which overcomes to a great extent the above as well as other problems of the prior art.

It is another object to provide a method for uniformly dyeing selected sections of a moving yarn strand wherein the lengths of the dyed sections can be readily varied within wide limits, as desired, to provide a uniformly dyed multicolor yarn product.

It is a further object to provide a method for uniformly and deeply dyeing relatively large, heavy denier yarns in multiple colors and at an extremely high rate of speed.

It is still a further object to provide a method for the uniform multicolor dyeing of a yarn in convenient form suitable for subsequent batch or steam fixation of the dyes and scouring of the yarns without bleeding or wicking of the dyes between differently colored sections in the yarn.

Figure 2:
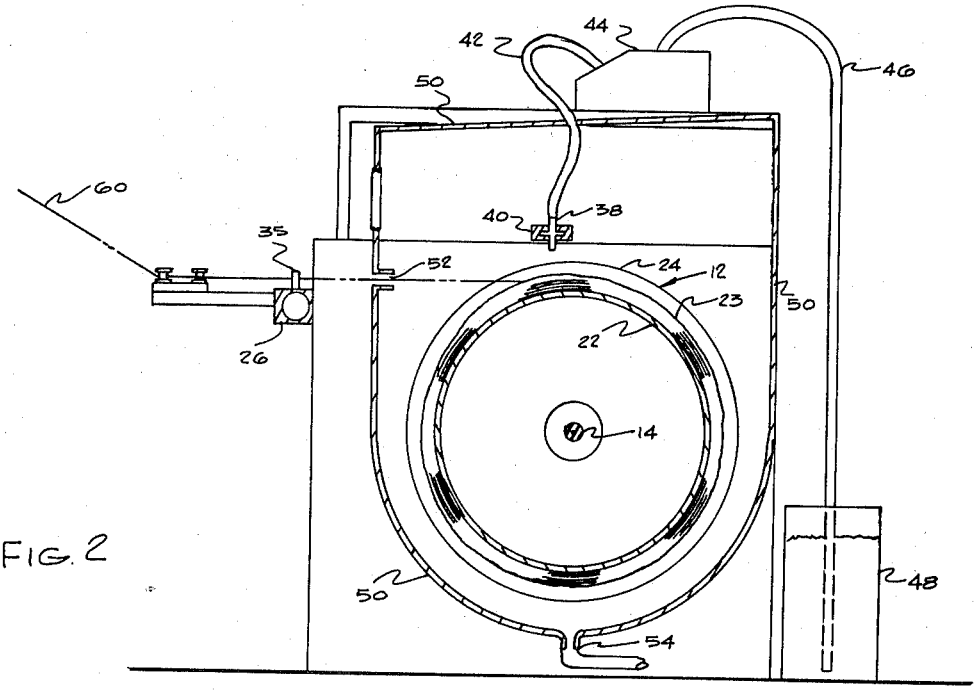

The above as well as other objects of the present invention will become more apparent, and the invention will be better understood, from the following detailed description of a preferred embodiment of the invention, when taken in conjunction with the accompanying drawings, in which:

FIG. 1 is a schematic front elevational view of dyeing apparatus of the present invention, with the front housing of the apparatus removed to show the interior components thereof; and FIG. 2 is a schematic sectional side elevational view of the apparatus taken generally along line II—II of FIG. 1.

Referring more specifically to the drawings, a preferred from of dyeing apparatus of the present invention is shown schematically in FIGS. 1 and 2. The apparatus comprises a pair of large yarn support drums 10, 12 which are removably mounted in tandem on opposite ends of a common drive shaft 14 for rotation therewith. Drive shaft 14 is suitably mounted for rotation on a support frame 16 and is rotatably driven by a pulley and belt arrangement 18 connecting the shaft to a variable speed electrical motor 20. The drums 10, 12 are of substantially identical construction and maybe formed of a suitable high strength material, such as stainless steel or the like. As seen, each drum has a central perforated barrel 22 for collecting a strand of yarn in a plurality of layers 23 (FIG. 2) thereon, and end flanges 24 for supporting the sides of the yarn layers wound on the barrel.

Each support drum is provided with a conventional type yarn traverse mechanism 26 each of which is mounted on and rotatably driven from a common drive shaft 30 mounted on the support frame and connected, by way of a belt and pulley arrangement 32, to a second variable speed motor 34. Each traverse mechanism includes a yarn guide eyelet 35 which reciprocates along the length of the barrel to direct the yarn strand back and forth across the barrel length during the winding operation.

Positioned in spaced relation above the barrel surface of each drum is a row of closely and uniformly spaced dye discharge outlets, or nozzles, 38 for continuously directing a plurality of discrete, cohesive streams of dye onto the outer surface of the yarn windings as the yarn is collected on the drum barrel. The discharge axes of the nozzles are substantially parallel and are positioned generally perpendicular to the drum winding axis to discharge the dye streams to form a plurality of narrow, contiguous radial bands 39 of color in the yarn windings along the length of the barrel. The nozzles 38 are mounted in a support bar 40 and the bar may be reciprocated along the length of the barrel by a small amount during winding to compensate for nozzle spacing and thus ensure sharply defined, contiguous color boundaries between the differently colored bands. Support bar 40 may be reciprocated by any suitable means, such as a motor, cam and mechanical linkage arrangement, shown schematically at 41.

Each of the dye nozzles 38 is connected by a flexible conduit or tube, only a few of which, 42, are shown, to one of a plurality of commonly driven peristaltic pumps, indicated schematically at 44. Each peristaltic pump is in turn connected by a supply conduit, one of which 46 is seen in FIG. 2, to one of a plurality of dye reservoirs or tanks 48 containing dyes of different colors. The number of dye tanks, pumps, nozzles and their particular connective arrangement obviously may be varied, depending upon the desired number of colors and location of the bands of color in the yarn windings on the drum. Although peristaltic pumps are particularly suitable because of their compact size and accuracy of dye delivery, the pumping means employed may be of any type which is capable of delivering precisely metered amounts of dye to each of the discharge nozzles at a selectively variable flow rate.

As best seen in FIG. 2, each drum and its associated dye applicator bar is peripherally enclosed in a housing or cowling 50 which serves as a shield to collect dye which is centrifugally expelled from the surface of the yarn on the drum during the winding operation, as will be explained. Each cowling 50 is provided with a narrow opening or slot 52 which extends the length of the traverse mechanism to permit passage of a yarn strand onto the surface of the drum during winding, and a lower dye discharge outlet 54 for removal of dye collected by the cowling during the dyeing operation. Each cowling 50 may include a window 56 to permit observation of the interior of the dyeing apparatus during the dyeing operation.

In operation, a yarn strand 60 is drawn continuously from a yarn supply source, such as a yarn package, creel, skein, or the like (not shown) through the guide eyelet 35 of the traverse mechanism onto the winding barrel of each drum. The drums are rotated at a selected high rate of speed by variable speed motor 20 and each traverse mechanism is rotated to traverse the yarn along the barrel length at an independently selected rate of speed by means of variable speed motor 34. During the winding operation, discrete cohesive streams of dye are continuously discharged from the dye nozzles at a selected flow rate to form narrow radial bands of color in the yarn along the lengths of the barrels. By selectively varying the speed of traverse of the yarn, the lengths of the individual dyed sections of the yarn may be accurately controlled. The slower the yarn traverse across the length of the barrel, the longer will be the length of each dyed section in the yarn. Correspondingly, the higher the traverse rate, the shorter will be the length of the sections. Since the end flanges 24 of the drums provide effective lateral support for the layers of yarn on the barrel, the speed of traverse of the yarn may be widely varied, independently of the rotational speed of the drum, without fear of "sloughing off" or break down of the ends of the package, as would be the case with conventional winding devices requiring controlled traverse to winding speed movement for proper package formation.

In practice of the method of the present invention by use of the herein described apparatus, the winding drums are continuously rotated at a preselected high rate of speed to produce a centrifugal force action which causes a portion of the dye liquid on the inner yarn layers on the drum to flow radially outwardly and penetrate the yarn strand bundles in the overlying yarn layers. Since the centrifugal force action on the dye is substantially perpendicular to the winding axis of the drum, the outward flow of the dye in each band of color is retained within that area to maintain a sharp color boundary between adjacent areas of color in the package. In addition, the continuous centrifugal force action tends to keep the retained dye liquid to fiber ratio in the dyed areas low so that subsequent flooding of one color into another does not occur at the boundaries of the areas. Excess dye liquid which is not absorbed by the yarn strand bundles in the dyed areas is expelled radially outwardly from the surface of the yarn package and is collected by the cowling for removal from the system. Thus, it can be seen that inward application of the dye to the outer surface of the package by the nozzles coupled with the centrifugal force outward flow of the dye from inner yarn windings to outer yarn windings on the drum produces a dye penetration of the yarn bundle from both sides of the yarn to provide uniform and deep coloration of the yarns.

The particular amount and rate of flow of dye applied to the yarn from the nozzles may be varied, depending upon the liquid absorption characteristics of the particular type and size of yarns to be dyed, the rate of yarn collection, and the particular color characteristics desired in the yarn product. Preferred parameters for particular yarns may be established by standard analysis or routine experimentation and observation.

The following example is given to illustrate the use of the method and apparatus of the present invention to uniformly dye a heavy denier nylon yarn in a plurality of colors.

EXAMPLE

A 1300 denier 2 ply nylon 6 yarn was wound onto a dyeing drum having a 50 centimeter diameter winding barrel 40 centimeters in length. The drum was rotated at 325 r.p.m. to give an average yarn take up speed of approximately 565 meters (231 grams) per minute. The yarn traverse mechanism was set to provide a linear traverse speed of approximately 4000 centimeters per minute across the drum.

Ten acid type dye solutions of different color were supplied from individual dye tanks to ten commonly driven peristaltic pumps and the outlet of each pump was connected by suitable conduits to two non-adjacent dye nozzle outlets of a 20 nozzle dye bar. The pumps were adjusted to deliver a flow rate of 37 milliliters of dye per minute per nozzle outlet, or approximately 3.2 milliliters of dye per gram of yarn collected. The nozzles, each having an internal outlet diameter of 0.794 millimeters, were uniformly spaced across the nozzle bar and the winding barrel length. The nozzle bar oscillation was adjusted so that the streams of dye solution formed contiguous radial bands of color each approximately 1.88 centimeters wide on the outer surface of the yarn being collected on the drum. The drum, traverse mechanism, and peristaltic pumps were simultaneously activated and approximately 10 pounds of yarn were collected while being dyed. The winding depth of the yarn on the drum was approximately 3.75 centimeters. After dyeing, the drum containing the yarn was removed from the winding machine and the yarn on the drum was scoured and dried in conventional manner.

Examination of the dyed yarn product revealed that the yarn strand bundle was uniformly dyed throughout in sectional lengths of individual colors of approximately 25 centimeters. The lines of demarkation between adjoining colors were remarkably sharp and the dye fastness of the colors in the yarn was excellent.

That which is claimed is:

1. A method for the high speed dyeing of a moving yarn strand to obtain a multicolored yarn product having uniformly dyed lengths of different color with sharply defined color boundaries therebetween, comprising the simultaneous steps of:

(a) winding a running yarn strand onto a rotating support member to form a plurality of yarn layers thereon;

(b) applying a plurality of discrete cohesive streams of dye to the outer surface of said layers while said yarn is being wound to form a plurality of radial bands of selected color in said layers located along the length of the support member;

(c) rotating said support member at a sufficient rate of speed to cause centrifugal flow of portions of dye in inner yarn layers in said radial bands of color radially outwardly in said bands to penetrate outer yarn layers therein; and (d) traversing the yarn strand across the support member to locate selected lengths of yarn in each of said radial bands of color.

2. A method as defined in claim 1 wherein the yarn is traversed across the support member during the winding thereof at a selectable rate of speed which is independent of the rotational speed of the support member.

3. A method as defined in claim 2 including the step of reciprocating said streams of dye along the length of the support package to form sharply defined contiguous boundaries between adjacent bands of color in said yarn layers.

4. A method for the high speed dyeing of a moving yarn strand to obtain a yarn having uniformly and sharply defined longitudinal dyed sections of different colors comprising the steps of:

(a) winding a yarn strand onto the surface of an elongate rotating yarn support member while traversing the yarn along the length of the member to form a plurality of layers of yarn on the surface of the support member, (b) continuously applying a plurality of discrete streams of dye, at least two of which are of different color, to the outer surface of the yarn in radial bands along the length of the support member while said yarn is being wound; and (c) rotating the yarn support member at a sufficient rate of speed to cause centrifugal force flow of dye radially outwardly from inner yarn layers in said areas to cause substantially complete and uniform application of dye throughout the yarn strand sections in each of said areas.

* * * * *